US005116523A

United States Patent [19]

Avery et al.

[11] Patent Number: 5,116,523

[45] Date of Patent: May 26, 1992

[54] SULFIDE ADDUCTS OF HIGH VISCOSITY INDEX POLYALPHAOLEFINS

[75] Inventors: Noyes L. Avery, Gwynedd Valley; Linda A. Benjamin, Horsham; Derek A. Law, Yardley, all of Pa.

[73] Assignee: Mobil Oil Corporation, New York, N.Y.

[21] Appl. No.: 210,598

[22] Filed: Jun. 23, 1988

[51] Int. Cl.[5] ..... C10M 136/04

[52] U.S. Cl. ..... 252/45; 568/18

[58] Field of Search ..... 252/45; 568/18

[56] References Cited

U.S. PATENT DOCUMENTS

| | | | |
|---|---|---|---|
| 4,11,659 | 3/1980 | Davis | 252/45 |
| 2,759,010 | 8/1956 | Lorenz et al. | 260/461 |
| 3,350,348 | 10/1967 | Braid et al. | 252/46.6 |
| 3,544,465 | 12/1970 | Braid | 252/46.6 |
| 3,574,795 | 4/1971 | Oswald et al. | 260/956 |
| 3,644,206 | 2/1972 | Braid | 252/46.7 |
| 3,793,203 | 2/1974 | Driscoll et al. | 252/45 |
| 3,972,243 | 8/1976 | Driscoll et al. | 252/45 |
| 4,119,550 | 10/1978 | Davis et al. | 252/45 |
| 4,147,640 | 4/1979 | Jayne et al. | 252/45 |
| 4,212,753 | 7/1980 | Horodysky | 252/46.6 |
| 4,240,958 | 12/1980 | Braid | 252/45 |
| 4,584,113 | 4/1986 | Walsh | 252/45 |
| 4,613,712 | 9/1986 | Bridger | 585/10 |
| 4,795,576 | 1/1989 | Born et al. | 252/45 |
| 4,827,064 | 5/1989 | Wu | 585/10 |
| 4,827,073 | 5/1989 | Wu | 585/530 |

FOREIGN PATENT DOCUMENTS 3427319 7/1984 Fed. Rep. of Germany .

OTHER PUBLICATIONS

Kirk-Othmer, Encyclopedia of Chemical Technology, vol. 14, John Wiley & Sons, pp. 496 and 497.

Weiss, "*Surface Compounds of Transition Metals*", J. Catalysis -8, 424-430, 1984.

*Primary Examiner*—William R. Dixon, Jr.
*Assistant Examiner*—E. McAvoy
*Attorney, Agent, or Firm*—Alexander J. McKillop; Charles J. Speciale; Malcolm D. Keen

[57] ABSTRACT

Sulfur derivatives of unsaturated oligomers formed from alpha-olefins of 2 to 20 carbon atoms which oligomer has a branch ratio of less than 0.19.

24 Claims, 5 Drawing Sheets

C13-NMR SPECTRA OF 1-HEXENE OLIGOMERS BY $Cr/SiO_2$ CATALYST

FIG.1
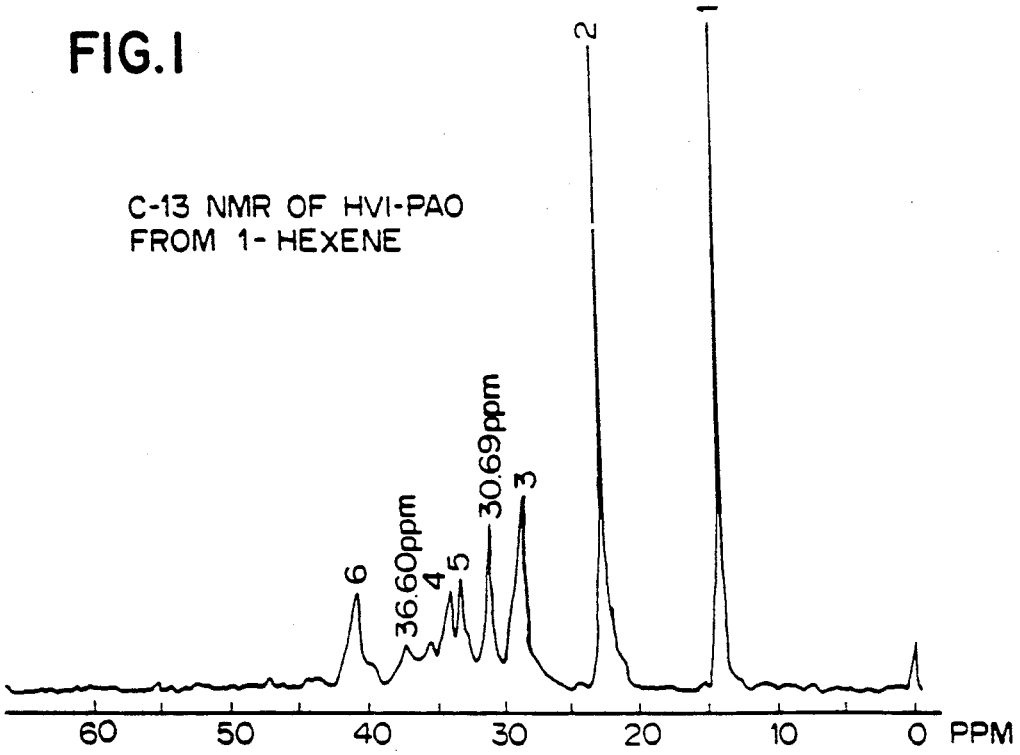
C13-NMR SPECTRA OF 1-HEXENE OLIGOMERS BY $Cr/SiO_2$ CATALYST
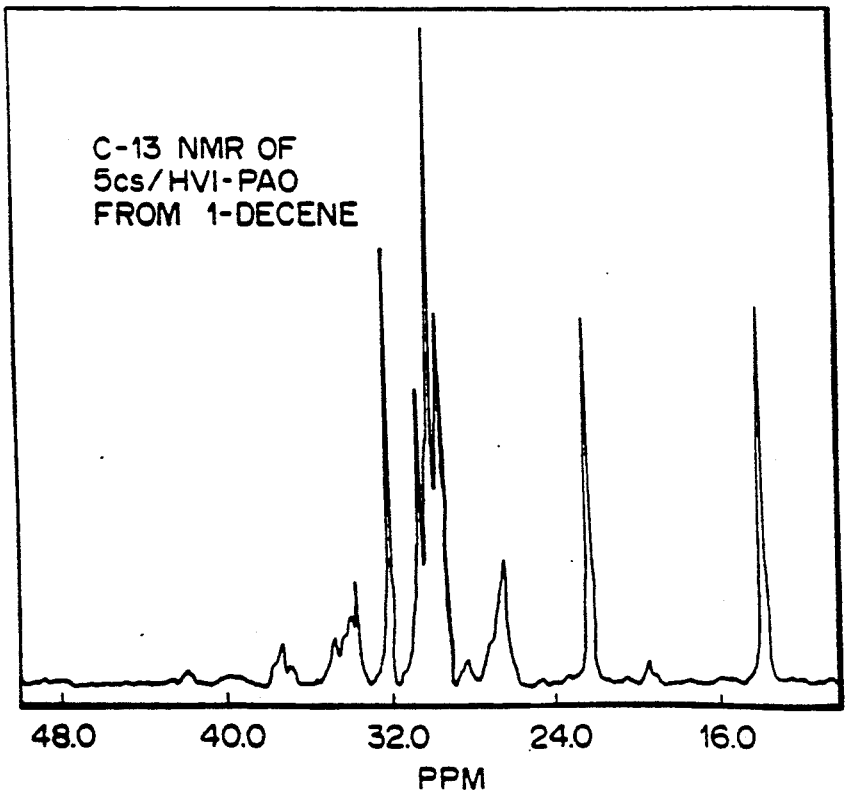
FIG.2

FIG.3
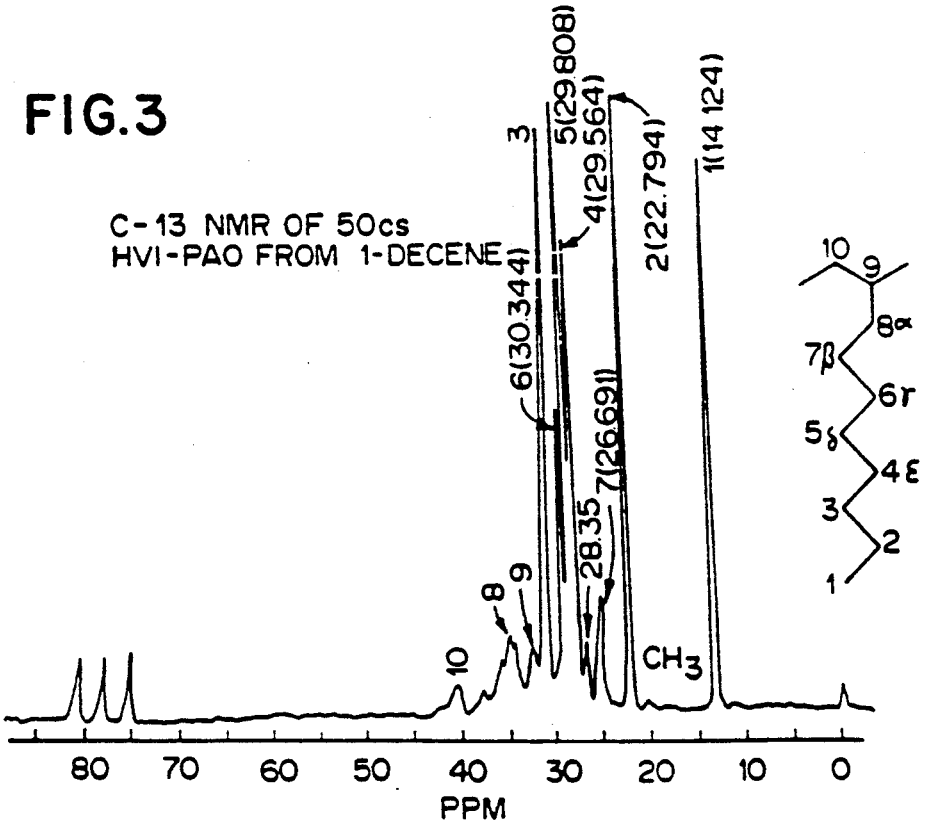
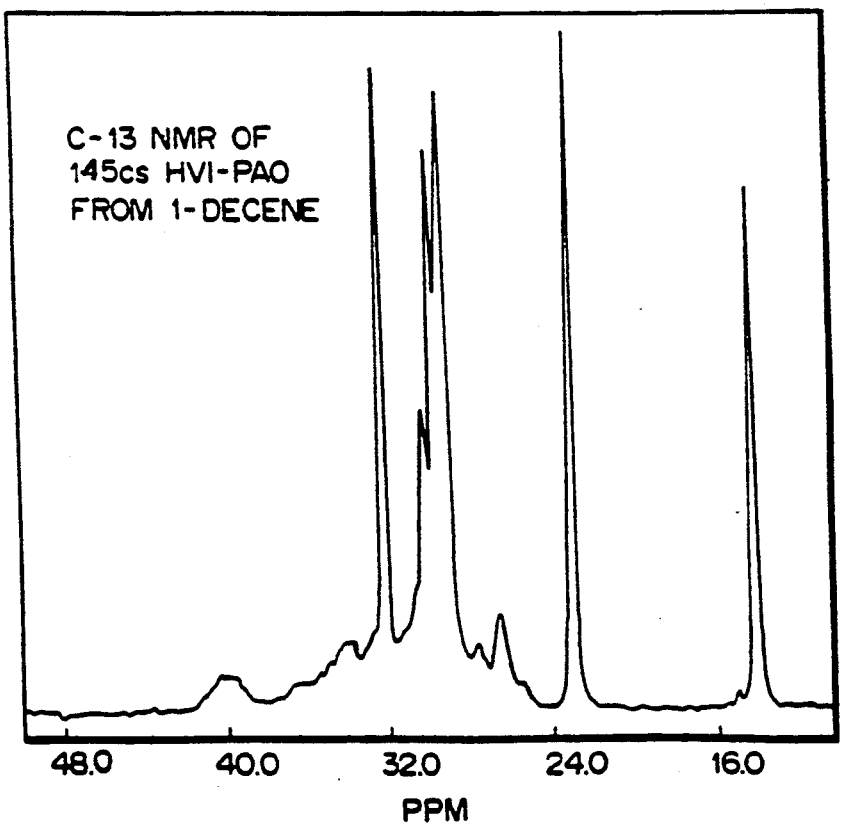
FIG.4

C-13 NMR OF HVI-PAO 1-DECENE TRIMER
OBSERVED VS CALCULATED SHIFTS

9-METHYL, 11-OCTYLHENEICOSANE

| CARBON POSITION | OBSERVED CHEMICAL SHIFT, PPM | CALCULATED CHEMICAL SHIFT, PPM |
|---|---|---|
| α' | 34.63 | 34.72 |
| β' | 26.99 | 27.27 |
| γ' | 30.40 | 30.21 |
| α'' | 37.81 | 37.16 |
| β'' | 26.99 | 27.27 |
| γ'' | 30.40 | 30.21 |
| $T_1$ | 35.13 | 34.98 |
| $T_2$ | 30.40 | 30.45 |
| M | 42.63 | 41.42 |
| M' | 20.26 | 20.12 |

11-OCTYLDOCOSANE

| CARBON POSITION | OBSERVED CHEMICAL SHIFT, PPM | CALCULATED CHEMICAL SHIFT, PPM |
|---|---|---|
| α' | 34.05 | 34.47 |
| β' | 27.23 | 27.52 |
| γ' | 29.62 | 30.21 |
| δ | 29.96 | 29.96 |
| $T_3$ | 37.81 | 37.05 |

SULFIDE ADDUCTS OF HIGH VISCOSITY INDEX POLYALPHAOLEFINS

FIELD OF THE INVENTION

The invention relates to sulfur adducts of polyalphaolefins and to use thereof as antiwear additives, and/or antioxidants, for hydraulic fluids, gear oils, and other lubricating systems. These compositions exhibit high viscosity indices and favorable pour point indices which are retained by formulations including these compositions. The compositions are free of zinc and phosphorus.

This invention relates to novel polyalpha-olefin lubricants containing sulfur functional groups which confer improved lubricant properties thereon. In particular, the invention relates to novel adducts of lubricants wherein typical properties of lubricant additive chemicals, such as extreme pressure antiwear, antirust, antioxidant properties, are incorporated into the lubricant molecular structure by sulfide functionalization.

This invention also relates to novel lubricant compositions exhibiting superior lubricant properties such as high viscosity indices. More particularly, this discovery provides novel lubricant basestocks, additives and blends of sulfide functionalized high viscosity index polyalphaolefin, herein sometimes called "HVI-PAO", with conventional lubricants, such as acid-catalyzed $C_{30}+$ liquid polyolefin synthetic lubes and/or mineral oil lubricant basestock.

BACKGROUND OF THE INVENTION

Synthetic oils were produced as lubricants to overcome the shortcomings in the properties of petroleum oils. In Kirk-Othmer, it is reported, that in 1929, polymerized olefins were the first synthetic oils to be produced commercially in an effort to improve the properties of petroleum oils. The greatest utility of synthetic oils has been for extreme temperatures. Above about 100°-125° C., petroleum oils oxidize rapidly; high viscosity and wax separation generally set a low temperature limit of −20° to −30° C. Outside this range, synthetics are almost a necessity; the same types of additives as those discussed for petroleum oils usually are used. Fire resistance, low viscosity-temperature coefficient, and water solubility are among the unique properties of synthetic oils. Cf. Kirk-Othmer, ENCYCLOPEDIA OF CHEMICAL TECHNOLOGY, "Lubrication and Lubricants, Vol. 14, p496 (1981). As representative synthetic hydrocarbon oils, the Kirk-Othmer reference refers to Mobil 1, SHC 824, and SHC 629 (also products of Mobil Oil Corporation), as well as to silicones, organic esters, phosphates, polyglycols, polyphenyl ethers, silicates and fluorochemicals, Kirk-Othmer, Vol. 14, p497.

The formulation of lubricants typically includes an additive package incorporating a variety of chemicals to improve or protect lubricant properties in application to specific situations, particularly internal combustion engine and machinery applications. The more commonly used additives include oxidation inhibitors, rust inhibitors, antiwear agents, pour point depressants, detergent-dispersants, viscosity index (VI) improvers, foam inhibitors and the like. This aspect of the lubricant arts is specifically described in Kirk-Othmer ENCYCLOPEDIA OF CHEMICAL TECHNOLOGY, 34d edition, Vol. 14, pp477-526, incorporated herein by reference. Considering the diversity of chemical structures represented by the plethora of additives incorporated in a typical lubricant formulation, and the quantity in which they are added, the artisan in the lubricant formulation arts faces a substantial challenge to provide a homogeneous formulation which will remain stable or in solution during inventory and during use. Lubricants, particularly synthetic lubricants of the type of interest in the instant invention, are usually hydrogenated olefins. Due to their hydrocarbon structure they are largely incompatible with polar additives such as antioxidants, antirust and antiwear agents, etc. Accordingly, in order to render the lubricants compatible with the polar additives large amounts of expensive polar organic esters must be added to the formulation. Useful commercial formulations may contain 20 percent or more of such esters as bis-tridecanol adipate for example, solely to provide a fully homogeneous lubricant blend of lubricant and additive.

Modifying the solvent properties of lubricants with solubilizing agents such as organic esters, while solving the problem of how to prepare stable blends with lubricant additives, creates or accentuates other performance related problems beyond the added burden on cost of the product. Accordingly, workers in the field are challenged by the need to incorporate the desirable properties of additives into lubricants, without incurring the usual physical and cost liabilities.

One class of lubricants of particular interest in the present invention are synthetic lubricants obtained by the oligomerization of olefins, particularly $C_6$-$C_{20}$ alpha olefins. Catalytic oligomerization of olefins has been studied extensively. Many catalysts useful in this area have been described, especially coordination catalyst and Lewis acid catalysts. Known olefin oliogomerization catalysts include the Ziegler-Natta type catalysts and promoted catalysts such as BF3 or AlCl3 catalysts. U.S. Pat. No. 4,613,712 for example, teaches the preparation of isotactic alpha-olefins in the presence of a Ziegler type catalyst. Other coordination catalysts, especially chromium on a silica support, are described by Weiss et al in Jour. Catalysis 88, 424-430 (1984) and in Offen. DE 3,427,319.

Poly alpha-olefin (PAO) oligomers as reported in literature or used in existing lube base stocks are usually produced by Lewis acid catalysis in which double bond isomerization of the starting alpha-olefin occurrs easily. As a result, the olefin oligomers have more short side ranches and internal olefin bonds. These side branches degrade their lubricating properties. Recently, a class of synthetic, oligomeric, polyalpha-olefin lubricants, has been discovered with a regular head-to-tail structure and containing a terminal olefinic bond. These lubricants have shown remarkably high viscosity index (VI) with low pour points and are especially characterized by having a low branch ratio, as defined hereinafter.

Accordingly, it is an object of the present invention to incorporate into that class of lubricants those properties typically associated with lubricant additives.

It is another object of the instant invention to improve properties by incorporating additive functional properties by forming adducts with sulfides or sources of sulfide group incorporation and yet another object is to provide those properties in lubricant compositions free of both zinc and phosphorus.

Yet another object of the instant invention is to improve lubricant properties of mineral oil based and synthetic lubricants by blending with sulfide functional group modified HVI-PAO.

SUMMARY OF THE INVENTION

Replacement of zinc dithiophosphates by zinc/phosphorus-free antiwear additives in hydraulic fluids, gear oils and various other lubricating systems is highly desirable because environmental considerations. In addition, a sulfur-containing additive which overcomes the problems of odor, staining, volatility is also highly desirable. Finally, an additive system or fluid which exhibits antiwear activity in combination with antioxidant activity and copper passivation is also of consequence.

In accordance with the invention, reaction products of chromium-catalyzed polyalphaolefin, e.g. 1-decene oligomers prepared by polymerizing 1-decene with a reduced chromium Ziegler catalyst, with sulfides exhibit excellent lubricating properties in conjunction with low odor, light color, non-staining, non-corrosive, extreme pressure/antiwear and antioxidant properties. Incorporation of the sulfur into the backbone of the chromium-oligomerized olefin provides the basis for improved extreme pressure/antiwear activity, thermal stability and lubricity. The use of these reaction products as a lubricant per se or as lubricant additives in either mineral or synthetic lubricant is unique and provides unexpected performance benefits due to an inherent internal synergism. The invention also relates to the enhancement of lubricating properties, via the addition of these reaction products, to either mineral or synthetic lubricant.

In addition, reaction between the aforementioned reaction products and amines or nitrogen-containing polymers which contain at least one free amine group provide unique multifunctional lubricants and lubricant additives.

DESCRIPTION OF THE DRAWINGS

FIG. 1 shows C-13 NMR spectra for HVI-PAO from 1-hexane.

FIG. 2 shows C-13 NMR spectra of 5 cs HVI-PAO from 1-decene.

FIG. 3 shows C-13 NMR spectra of 50 cs HVI PAO from 1-decene.

FIG. 4 shows C-13 NMR spectra of 145 cs HVI-PAO from 1-decene.

DETAILED DESCRIPTION OF THE INVENTION

Figure 5:
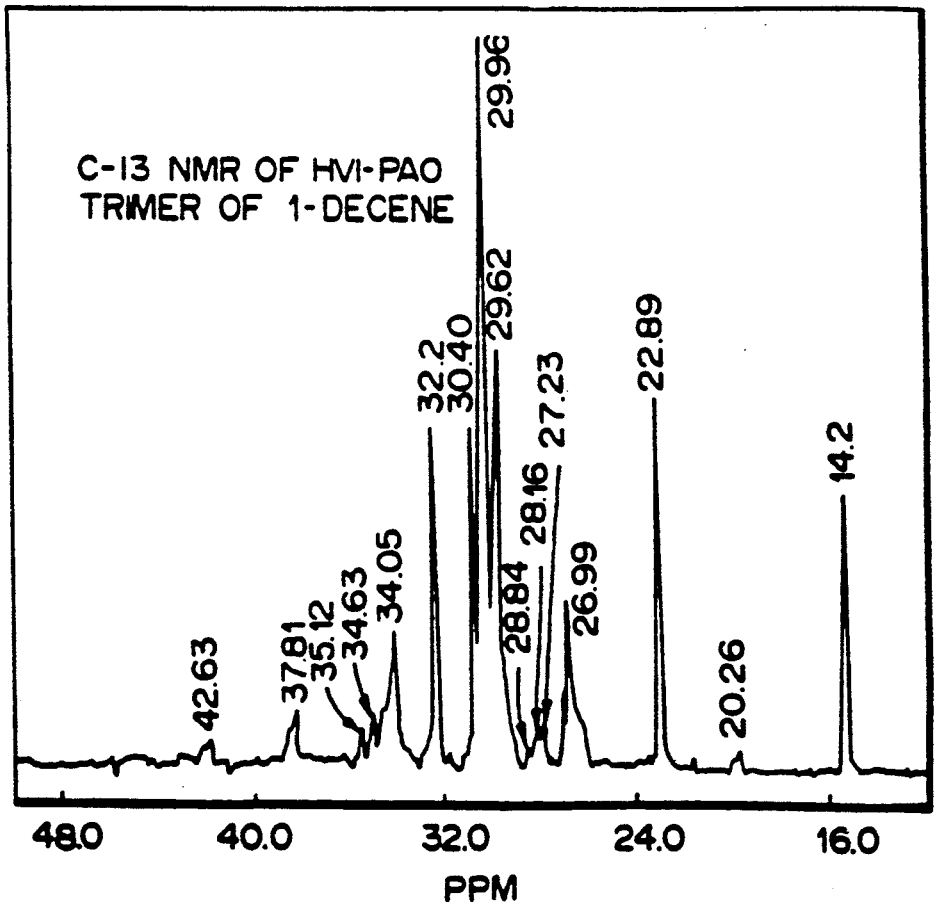
FIG. 5 shows C-13 NMR of HVI-PAO trimer of 1-decene.
Figure 6:
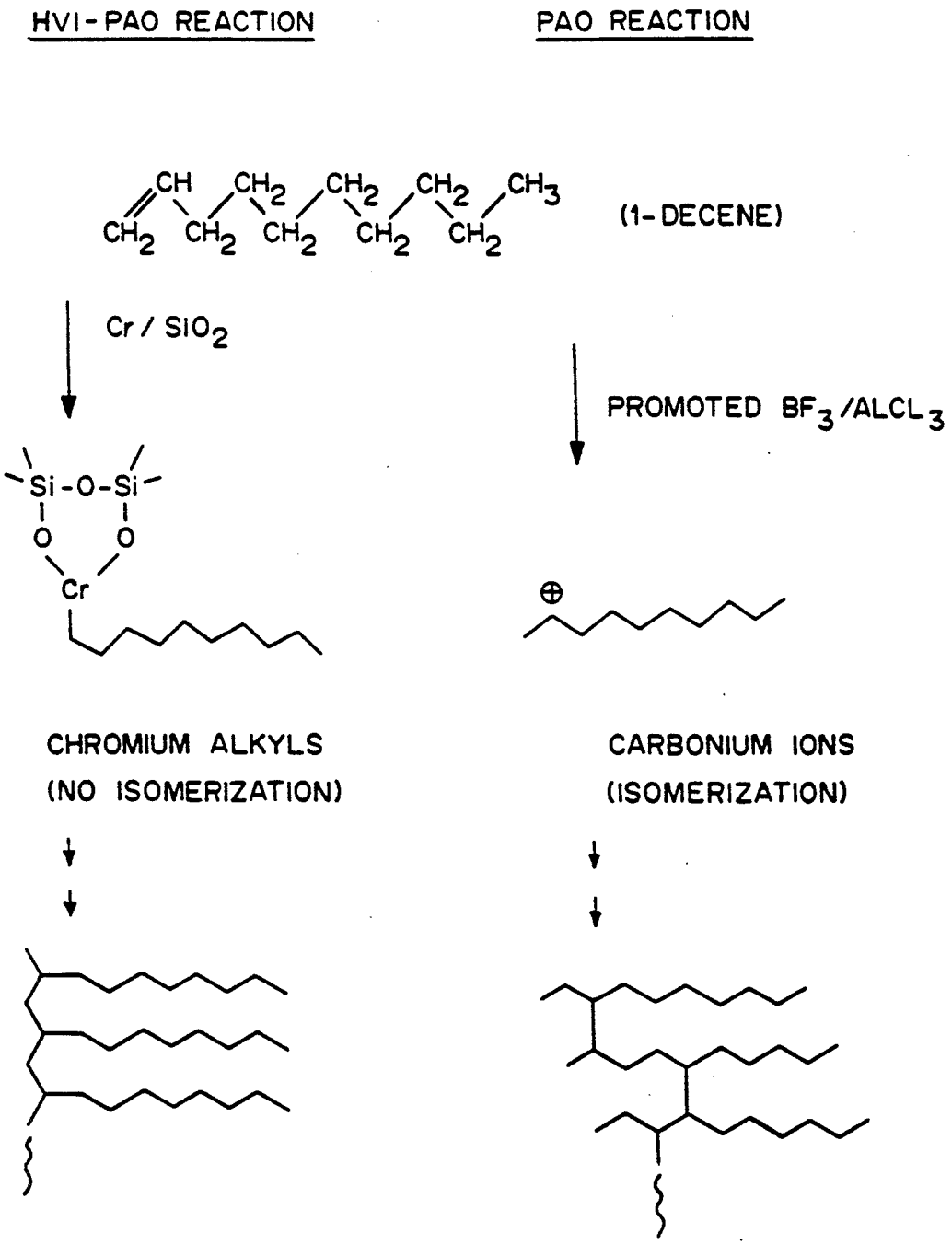
FIG. 6 is a comparison of PAO and HVI-PAO, production.
Figure 7:
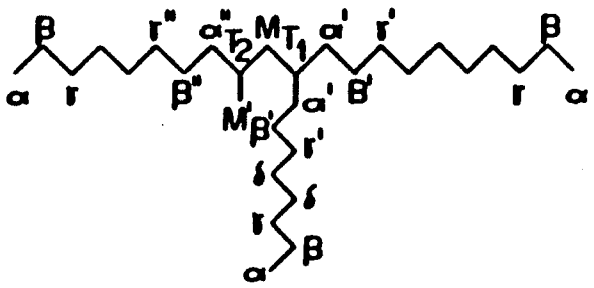
FIG. 7 shows C-13 NMR calculated vs. observed chemical shifts for HVI-PAO 1-decene trimer components.
Figure 7:
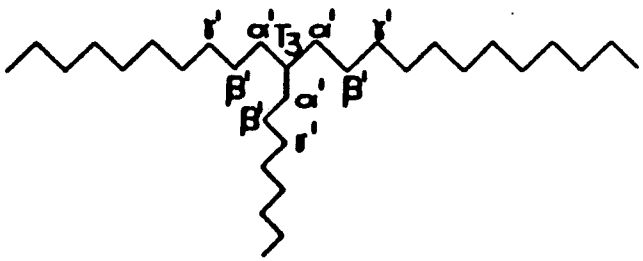

The sulfide derivatives of oligomers are the reaction products of the alpha-olefin oligomers with methyl to methylene branch ratio of less than 0.19 formed of alphaolefins and sulfur or sources of sulfur.

Oligomers

The alpha-olefin oligomers are liquid hydrocarbons which are the subject of copending application Ser. No. 147,064, filed Jan. 22, 1988 which is a continuation of Ser. No. 946,226 filed Dec. 24, 1986 These novel oligomers are designated below by the abbrevition HVI-PAO for high viscosity index polyalpha olefins. That abbreviation is to be distinguished from PAO which refers to conventional polyalphaolefins. The PAO include Mobil 1, referenced above. The HVI-PAO can be distinguished from the PAO inter alia on methyl group methylene branch ratio, discussed below.

The branch ratios defined as the ratios of $CH_3$ groups to $CH_2$ groups in the oligomer are calculated from the weight fractions of methyl groups obtained by infrared methods, published in *Analytical Chemistry*, Vol. 25, No. 10, p. 1466 (1953).

$$\text{Branch ratio} = \frac{\text{wt fraction of methyl group}}{1 - (\text{wt fraction of methyl group})}$$

It has been found that the process described herein to produce the novel HVI-PAO oligomers can be controlled to yield oligomers having weight average molecular weight between 300 and 45,000 and number average molecular weight between 300 and 18,000. Measured in carbon numbers, molecular weights range from $C_{30}$ to $C_{1300}$ and viscosity up to 750 cs at 100° C., with a preferred range of $C_{30}$ to $C_{1000}$ and a viscosity of 500 cs at 100° C. Molecular weight distributions (MWD), defined as the ratio of weight average molecular to number average molecular weight, range from 1.00 to 5, with a preferred range of 1.01 to 3 and a more preferred MWD of about 2.5. Compared to conventional PAO derived from $BF_3$ or $AlCl_3$ catalyzed polymerization of 1-alkene, HVI-PAO of the present invention has been found to have a higher proportion of higher molecular weight polymer molecules in the product.

Viscosities of the novel HVI-PAO oligomers measured at 100° C. range from 3 cS to 5000 cS. The viscosity index for the new polyalpha-olefins is defined by the following equation:

$$VI = 129.8 + 4.58 \times (V_{100}°C.)0.5,$$

where $V_{100}$°C. is kinematic viscosity in centistokes.

The novel oligomer compositions disclosed herein have been examined to define their unique structure beyond the important characteristics of branch ratio and molecular weight already noted. Dimer and trimer fractions have been separated by distillation and components thereof further separated by gas chromatography. These lower oligomers and components along with complete reaction mixtures of HVI-PAO oligomers have been studied using infra-red spectroscopy and C-13 NMR. The studies have confirmed the highly uniform structural composition of the products of the invention, particularly when compared to conventional polyalphaolefins produced by $BF_3$, $AlCl_3$ or Ziegler-type catalysis. The unique capability of C-13 NMR to identify structural isomers has led to the identification of distinctive compounds in lower oligomeric fractions and served to confirm the more uniform isomeric mix present in higher molecular weight oligomers compatible with the finding of low branch ratios and superior viscosity indices.

The oligomers used in the present invention are formed from olefins comtaining from 2 to about 20 carbon atoms such as ethylene, propylene, 1-butene, 1-pentene, 1-hexene, 1-octene, 1-decene, 1-dodecene and 1-tetradecene and branched chain isomers such as 4-methyl-1-pentene. Also suitable for use are olefin-containing refinery feedstocks or effluents. However, the olefins used in this invention are preferably alpha olefinic as for example 1-heptene to 1-hexadecene and more preferably 1-octene to 1-tetradecene, or mixtures of such olefins.

Oligomers of alpha-olefins in accordance with the invention have a low branch ratio of less than 0.19 and superior lubricating properties compared to the alpha-olefin oligomers with a high branch ratio, as produced in all known commercial methods.

This new class of alpha-olefin oligomers are prepared by oligomerization reactions in which a major proportion of the double bonds of the alphaolefins are not isomerized. These reactions include alpha-olefin oligomerization by supported metal oxide catalysts, such as Cr compounds on silica or other supported IUPAC Periodic Table Group VIB compounds. The catalyst most preferred is a lower valence Group VIB metal oxide on an inert support. Preferred supports include silica, alumina, titania, silica-alumina, magnesia and the like. The support material binds the metal oxide catalyst. Those porous substrates having a pore opening of at least 40 angstroms are preferred.

The support material usually has high surface area and large pore volumes with average pore size of 40 to about 350 angstroms. The high surface area are beneficial for supporting large amount of highly dispersive, active chromium metal centers and to give maximum efficiency of metal usage, resulting in very high activity catalyst. The support should have large average pore openings of at least 40 angstroms, with an average pore opening of greater than about 60 to 300 angstroms preferred. This large pore opening will not impose any diffusional restriction of the reactant and product to and away from the active catalytic metal centers, thus further optimizing the catalyst productivity. Also, for this catalyst to be used in fixed bed or slurry reactor and to be recycled and regenerated many times, a silica support with good physical strength is preferred to prevent catalyst particle attrition or disintegration during handling or reaction.

The supported metal oxide catalysts are preferably prepared by impregnating metal salts in water or organic solvents onto the support. Any suitable organic solvent known to the art may be used, for example, ethanol, methanol, or acetic acid. The solid catalyst precursor is then dried and calcined at 200° to 900° C. by air or other oxygen-containing gas. Thereafter the catalyst is reduced by any of several various and well known reducing agents such as, for example, CO, $H_2$, $NH_3$, $H_2S$, $CS_2$, $CH_3SCH_3$, $CH_3SSCH_3$, metal alkyl containing compounds such as $R_3Al$, $R_3B$,$R_2Mg$, RLi, $R_2Zn$, where R is alkyl, alkoxy, aryl and the like. Preferred are CO or $H_2$ or metal alkyl containing compounds.

Alternatively, the Group VIB metal may be applied to the substrate in reduced form, such as Cr(II) compounds. The resultant catalyst is very active for oligomerizing olefins at a temperature range from below room temperature to about 250° C. at a pressure of 0.1 atmosphere to 5000 psi. Contact time of both the olefin and the catalyst can vary from one second to 24 hours. The catalyst can be used in a batch type reactor or in a fixed bed, continuous-flow reactor.

In general the support material may be added to a solution of the metal compounds, e.g., acetates or nitrates, etc., and the mixture is then mixed and dried at room temperature. The dry solid gel is purged at successively higher temperatures to about 600° for a period of about 16 to 20 hours. Thereafter the catalyst is cooled down under an inert atmosphere to a temperature of about 250° to 450° C. and a stream of pure reducing agent is contacted therewith for a period when enough CO has passed through to reduce the catalyst as indicarted by a distinct color change from bright orange to pale blue. Typically, the catalyst is treated with an amount of CO equivalent to a two-fold stoichiometric excess to reduce the catalyst to a lower valence CrII state. Finally the catalyst is cooled down to room temperature and is ready for use.

The product oligomers have a very wide range of viscosities with high viscosity indices suitalble for high performance lubrication use. The product oligomers also have atactic molecular structure of mostly uniform head-to-tail connections with some head-to-head type connections in the structure. These low branch ratio oligomers have high viscosity indices at least about 15 to 20 units and typically 30–40 units higher than equivalent viscosity prior art oligomers, which regularly have higher branch ratios and correspondingly lower viscosity indices. These low branch oligomers maintain better or comparable pour points.

As referenced hereinbefore, supported Cr metal oxide in different oxidation states is known to polymerize alpha olefins from $C_3$ to $C_{20}$ (DE 3427319 to H. L. Krauss and Journal of Catalysis 88, 424–430, 1984) using a catalyst prepared by $CrO_3$ on silica. The referenced disclosures teach that polymerization takes place at low temperature, usually less than 100° C., to give adhesive polymers and that at high temperature, the catalyst promotes isomerization, cracking and hydrogen transfer reactions. The present inventions produce low molecular weight oligomeric products under reaction conditions and using catalysts which minimize side reactions such as 1-olefin isomerization, cracking, hydrogen transfer and aromatization. To produce the novel low molecular weight products suitable for use as lube basestock or as blending stock with other lube stock, the reaction of the present invention is carried out at a temperature higher (90°–250° C.) than the temperature suitable to produce high molecular weight polyalpha-olefins. The catalysts used in the present invention do not cause a significant amount of side reactions even at high temperature when oligomeric, low molecular weight fluids are produced.

The catalysts for this invention thus minimize all side reactions but oligomerize alpha olefins to give low molecular weight polymers with high efficiency. It is well known in the prior art that chromium oxides, especially chromia with average +3 oxidation states, either pure or supported, catalyze double bond isomerization, dehydrogenation, cracking, etc. Although the exact nature of the supported Cr oxide is difficult to determine, it is thought that the catalyst of the present invention is rich in Cr(II) supported on silica, which is more active to catalyze alpha-olefin oligomerization at high reaction temperature without causing significant amounts of isomerization, cracking or hydrogenation reactions, etc. However, catalysts as prepared in the cited references can be richer in Cr (III). They catalyze alpha-olefin polymerization at low reaction temperature to produce high molecular weight polymers. However, as the references teach, undesirable isomerization, cracking and hydrogenation reaction takes place at higher temperatures. In contrast, high temperatures are needed in this invention to produce lubricant products. The prior art also teaches that supported Cr catalysts rich in Cr(III) or higher oxidation states catalyze 1-butene isomerization with $10^3$ higher activity than polymerization of 1-butene. The quality of the catalyst, method of preparation, treatments and reaction conditions are critical to the catalyst performance and composition of the product produced and distinguish the present invention over the prior art.

In the instant invention very low catalyst concentrations based on feed, from 10 wt % to 0.01 wt %, are used to produce oligomers; whereas, in the cited references catalyst ratios based on feed of 1:1 are used to prepare high polymer. Resorting to lower catalyst concentrations in the present invention to produce lower molecular weight material runs counter to conventional polymerization theory, compared to the results in the cited references.

The oligomers of 1-olefins prepared in this invention usually have much lower molecular weights than the polymers produced in cited reference which are semi-solids, with very high molecular weights. The higher molecular weight polymers are not suitable as lubricant basestocks. These high polymers usually have no detectable amount of dimer or trimer ($C_{10}$–$C_{30}$) components from synthesis. These high polymers also have very low unsaturations. However, products in this invention are free-flowing liquids at room temperature, suitable for lube basestock, containing significant amount of dimer or trimer and have high unsaturations.

The Sulfur Derivatives of the Invention

Sulfur reacts with unsaturated materials in the liquid phase, at temperature above its melting point, at which a solution-dispersion is formed. Although the oligomer products may be hydrogenated prior to use per se, the oligomers are not hydrogenated prior to reaction herein described. Practically, the temperature of reaction will range from 140° C. to 180° C. Generally, sulfides, disulfides, polysulfides and admixtures thereof are formed.

Sulfurization of chromium-catalyzed polyalphaolefins with sulfur and/or hydrogen sulfide in the presence of a sulfur-containing heterocycle, e.g. dimercaptothiadiazole, mercapto-benzimidazole, mercaptobenzothiazole, can lead to products with enhanced sulfur content and low corrosivity. The sulfur content will range from 0.01 to 5, and preferably from 0.1 to 1 moles based on the oligomer. Expressed in other terms, the sulfur adducts of the invention can contain 0.01 to 10 weight percent sulfur, preferably 0.1 to 5 weight percent sulfur. These adducts should possess good antiwear and antioxidant properties. Because these adducts have a high molecular weight, volatility is no longer a concern; in addition color and odor are no longer a problem which is prevalent with the use of low molecular weight olefins. Adducts derived from the chromium-catalyzed olefin and phosphorus sulfides should provide enhanced antioxidant antiwear properties from the synergism between the sulfur and phosphorus. Sulfurization with sulfur halides, (e.g., $S_2Cl$, $S_2Cl_2$, etc.) leads to sulfochlorinated intermediates capable of undergoing additional chemistries. For example, the sulfochlorinated intermediate can be reacted with any mercaptan or heterocycle, as mentioned above, or undergo dehydrohalogenation. The intermediates may also be reacted with amines, functionalized amines, phosphorus containing compounds in order to achieve desired properties, e.g., dispersancy, detergency, EP/antiwear, antioxidant, emulsifier, demulsifier, corrosion inhibiting, antirust inhibitor, antistaining, friction reducing and the like.

Post-reactions of these unique sulfurized olefin with a scavenger olefin can lead to a product with unequaled low corrosivity and improved solubility and performance properties.

The products obtained from the reaction of a chromium-catalyzed polyalphaolefin and various distinct sulfur sources are unique not only in composition and structure but in utility. Part of the uniqueness is derived from the chromium-catalyzed olefin oligomers themselves; generally they have a higher VI at a given viscosity and have enhanced reactivity over traditional high VI lube olefin. In addition, the chromium-catalyzed olefin oligomers have improved thermal stability over comparable polyisobutylene olefins. The incorporation of sulfur onto the backbone of these olefins imparts some unique and much desired properties such as enhanced solubility, low corrosivity, excellent extreme pressure/antiwear properties, good antioxidant properties, low color, low odor and non-staining over traditional sulfurized olefins, e.g., sulfurized isobutylenes. In addition to the above properties, these materials have demonstrated good thermal stability and excellent lubricity.

The following examples of the instant invention are presented by way of illustration and are not intended to limit the scope of the present invention.

EXAMPLES

In preparing the sulfur derivatives of the invention described in Examples A–H below, two HVI-PAO were employed by the syntheses now described.

A HVI-PAO having a nominal viscosity of 20 cSt at 100° C. was prepared by the following procedure. 100 weights of 1-decene which had been purified by nitrogen sparging and passing over a 4A molecular sieve was charged to a dry nitrogen blanketed reactor. The decene was then heated to 185° C. and 3.0 weights of a prereduced 1% Chromium on silica catalyst added together with an additional 500 weights of purified 1-decene continuously over a period of 7.0 hr with the reaction temperature maintained at 185° C. The reactants were held for an additional 5.0 hr at 185° C. after completion of the 1-decene and catalyst addition to complete the reacton. The product was then filtered to remove the catalyst and stripped to 270° C. and 2 mm Hg pressure to remove unreacted 1-decene and unwanted low molecular weight oligomers.

A HVI-PAO having a nominal viscosity of 149 cSt at 100° C. was prepared by a procedure similar to the above except that the 1-decene/catalyst addition time was 9.0 hr, the hold time after 1-decene/catalyst addition was 2.0 hr, and the reaction temperature was 123° C.

EXAMPLE A

A suspension of 100 g (0.100 mole) of a 20 cSt lube olefin and 3.2 g (0.100 mole) of sulfur was heated to 140° C. in a stirred, glass reactor under a nitrogen sparge. The reaction mixture was held at 140° C. for 2.5 h. The reaction mixture was then cooled to room temperature at which time 100 ml of hexane was added and stirred for 0.5 h. The reaction mixture was filtered to remove any unreacted sulfur (1.82 g). The product was then vacuum filtered through diatomaceous clay and volatiles were removed in-vacuo to yield a clear yellow oil (94.5 g).

The product had the following elemental analysis:

| | Found | Calc. |
|---|---|---|
| % S | 1.10 | 3.1 |

EXAMPLE B

The procedure of Example 1 was repeated using 100.0 g (0.100 mole) of a 20 cSt lube olefin and 1.6 g (0.05 mole) of sulfur. The product was a clear yellow oil (92.39 g) and had the following elemental analysis:

| | Found | Calc. |
|---|---|---|
| % S | 0.92 | 1.57 |

EXAMPLE C

The procedure of Example 1 was repeated using 100 g (0.100 mole) of a 20 cSt lube olefin and 0.32 g (0.01 mole) of sulfur. The product was a clear yellow oil (95.34 g) and had the following elemental analysis:

| | Found | Calc. |
|---|---|---|
| % S | 0.3 | 0.32 |

EXAMPLE D

The procedure of Example 1 was repeated using 30 g (0.030 mole) of a 20 cSt lube olefin, 0.48 g (0.015 mole) of sulfur and 0.45 g (0.003 mole) of 2,5-dimercapto-1,3,4,-thiadiazole. The product was a clear yellow oil (26.95 g).

EXAMPLE E

The procedure of Example 1 was repeated using 100 g (0.03 mole) of a 145 cSt lube olefin and 1.0 g (0.03 mole) of sulfur. The product was a clear yellow oil (97.46 g) and had the following elemental analysis:

| | Found | Calc. |
|---|---|---|
| % S | 0.5 | 1.0 |

EXAMPLE F

The procedure of Example 1 was repeated using 100 g (0.03 mole) of a 145 cSt lube olefin and 0.5 g (0.015 mole) of sulfur. The product was a clear light yellow oil (99.73 g) and had the following elemental analysis:

| | Found | Calc. |
|---|---|---|
| % S | 0.5 | 0.5 |

EXAMPLE G

The procedure of Example 1 was repeated using 100 g (0.03 mole) of a 145 cSt lube olefin and 0.1 g (0.003 mole) of sulfur. The product was a clear colorless oil (94.96 g) and had the following elemental analysis:

| | Found | Calc. |
|---|---|---|
| % S | 0.1 | 0.1 |

EXAMPLE H

The procedure of Example 1 was repeated using 30 g (0.0094 mole) of a 145 cSt lube olefin, 0.15 g (0.0046 mole) of sulfur and 0.14 g (0.00094 mole) of 2,5-dimercapto-1,3,4-thiadiazole. The product was a clear yellow oil (26.55 g).

Performance as Antiwear Additives and Functionalized Fluids

The products of the above examples were initially evaluated as functionalized fluids. The results were compared to an all synthetic brand automotive engine oil as well as the unfunctionalized lube olefin. These data were obtained on a Four-Ball Wear Apparatus (2000 rpm, 200° F., 60 kg).

| Test Oil | Wear Scar (mm) | Volume ($v \times 10^3$ $mm^3$) |
|---|---|---|
| 20 cSt Lube Olefin | 4.8 | 8082.0 |
| Example A | 2.1 | 323.8 |
| Example B | 1.8 | 175.4 |
| Example C | 1.3 | 39.0 |
| Example D | 2.7 | 926.7 |
| 145 cst Lube Olefin | 0.7 | 3.2 |
| Example E | 1.6 | 93.0 |
| Example F | 1.6 | 93.0 |
| Example G | 0.6 | 2.2 |
| Example H | 0.8 | 7.8 |

The products of the above examples were also evaluated at 2 wt % concentration in a standard test mineral oil. The results were compared to the test oil without additive. These data were obtained on the Four-Ball Wear Apparatus (2000 rpm, 200° F., 60 kg).

| | Additive Concentration wt % | Wear Scar (mm) | Volume ($V \times 10^3$ $mm_3$) |
|---|---|---|---|
| Test Oil | 0 | 2.4 | 550.6 |
| 20 cSt Lube Olefin | 0 | 3.4 | 2173.4 |
| Example A | 2 | 1.5 | 84.8 |
| Example B | 2 | 0.9 | 10.8 |
| Example C | 2 | 2.8 | 1000.9 |
| Example D | 2 | 1.4 | 63.4 |
| 145 cSt Lube Olefin | 0 | 4.0 | 4017.4 |
| Example E | 2 | 1.4 | 60.2 |
| Example F | 2 | 1.8 | 162.0 |
| Example H | 2 | 2.2 | 393.7 |

These data illustrate that the instant compounds function as effective antiwear additives in a mineral base stock.

The use of a non-zinc antiwear additive as a suitable replacement for zinc dithiophosphate is highly desirable. For example, hydraulic fluids formulated with Zn dithiophosphate are becoming environmentally unacceptable. Currently non-zinc antiwear additives are required for use in synthetic automotive engine oils.

Sulfurized additives derived from high-VI lube olefins have very light colors and better odor compared to traditional sulfurized olefins. This new generation of antiwear additives is expected to have good solubility in synthetic base stocks, e.g., extra-high VI base stocks, as well as low corrosivity. Sulfurized multi-functional lubricant fluids are expected to excel in performance features as a result of the multifaceted initial synergism.

The following examples describe the production of other HVI-PAO and properties thereof.

EXAMPLE 1

Catalyst Preparation and Activation Procedure 1.9 grams of chromium (II) acetate ($Cr_2(OCOCH_3)_4 2H_2O$) (5.58 mmole) (commercially obtained) is dissolved in 50 cc of hot acetic acid. Then 50 grams of a silica gel of 8–12 mesh size, a surface area of 300 $m^2/g$, and a pore volume of 1 cc/g, also is added. Most of the solution is absorbed by the silica gel. The final mixture is mixed for half an hour on a rotavap at room temperature and dried in an open-dish at room temperature. First, the dry solid (20 g) is purged with $N_2$ at 250° C. in a tube furnace. The furnace temperature is then raised to 400° C. for 2 hours. The temperature is then set at 600° C. with dry air purging for 16 hours. At this time the catalyst is cooled down under $N_2$ to a temperature of 300° C. Then a stream of pure CO (99.99% from Matheson) is introduced for one hour. Finally, the catalyst is cooled down to room temperature under $N_2$ and ready for use.

EXAMPLE 2

The catalyst prepared in Example 1 (3.2 g) is packed in a ⅜" stainless steel tubular reactor inside an $N_2$ blanketed dry box. The reactor under $N_2$ atmosphere is then heated to 150° C. by a single-zone Lindberg furnace. Pre-purified 1-hexene is pumped into the reactor at 140 psi and 20 cc/hr. The liquid effluent is collected and stripped of the unreacted starting material and the low boiling material at 0.05 mm Hg. The residual clear, colorless liquid has viscosities and VI's suitable as a lubricant base stock.

| Sample | Prerun | 1 | 2 | 3 |
|---|---|---|---|---|
| T.O.S., hr. | 2 | 3.5 | 5.5 | 21.5 |
| Lube Yield, wt % | 10 | 41 | 74 | 31 |
| Viscosity, cS, at | 208.5 | 123.3 | 104.4 | 166.2 |
| 40° C. | | | | |
| 100° C. | 26.1 | 17.1 | 14.5 | 20.4 |
| VI | 159 | 151 | 142 | 143 |

EXAMPLE 3

Similar to Example 2, a fresh catalyst sample is charged into the reactor and 1-hexene is pumped to the reactor at 1 atm and 10 cc per hour. As shown below, a lube of high viscosities and high VI's is obtained. These runs show that at different reaction conditions, a lube product of high viscosities can be obtained.

| Sample | A | B |
|---|---|---|
| T.O.S., hrs. | 20 | 44 |
| Temp., °C. | 100 | 50 |
| Lube Yield, % | 8.2 | 8.0 |
| Viscosity, cS, at | 13170 | 19011 |
| 40° C. | | |
| 100° C. | 620 | 1048 |
| VI | 217 | 263 |

EXAMPLE 4

A commercial chrome/silica catalyst which contains 1% Cr on a large-pore volume synthetic silica gel is used. The catalyst is first calcined with air at 800° C. for 16 hours and reduced with CO at 300° C. for 1.5 hours. Then 3.5 g of the catalyst is packed into a tubular reactor and heated to 100° C. under the $N_2$ atmosphere. 1-Hexene is pumped through at 28 cc per hour at 1 atmosphere. The products are collected and analyzed as follows:

| Sample | C | D | E | F |
|---|---|---|---|---|
| T.O.S., hrs. | 3.5 | 4.5 | 6.5 | 22.5 |
| Lube Yield, % | 73 | 64 | 59 | 21 |
| Viscosity, cS, at | 2548 | 2429 | 3315 | 9031 |
| 40° C. | | | | |
| 100° C. | 102 | 151 | 197 | 437 |
| VI | 108 | 164 | 174 | 199 |

These runs show that different Cr on a silica catalyst are also effective for oligomerizing olefins to lube products.

EXAMPLE 5

As in Example 4, purified 1-decene is pumped through the reactor at 250 to 320 psi. The product is collected periodically and stripped of light products boiling points below 650° F. High quality lubes with high VI are obtained (see following table).

| Reaction | WHSV | Lube Product Properties | | |
|---|---|---|---|---|
| Temp. °C. | g/g/hr | V at 40° C. | V at 100° C. | VI |
| 120 | 2.5 | 1555.4 cs | 157.6 cs | 217 |
| 135 | 0.6 | 389.4 | 53.0 | 202 |
| 150 | 1.2 | 266.8 | 36.2 | 185 |
| 166 | 0.6 | 67.7 | 12.3 | 181 |
| 197 | 0.5 | 21.6 | 5.1 | 172 |

EXAMPLE 6

Similar catalyst is used in testing 1-hexene oligomerization at different temperature. 1-Hexene is fed at 28 cc/hr and at 1 atmosphere.

| Sample | G | H |
|---|---|---|
| Temperature, °C. | 110 | 200 |
| Lube Yield, wt. % | 46 | 3 |
| Viscosities, cS, at | 3512 | 3760 |
| 40° C. | | |
| 100° C. | 206 | 47 |
| VI | 174 | 185 |

EXAMPLE 7

1.5 grams of a similar catalyst as prepared in Example 4 was added to a two-neck flask under $N_2$ atmosphere. Then 25 g of 1-hexene was added. The slurry was heated to 55° C. under $N_2$ atmosphere for 2 hours. Then some heptane solvent was added and the catalyst was removed by filtration. The solvent and unreacted starting material was stripped off to give a viscous liquid with a 61% yield. This viscous liquid had viscosities of 1536 and 51821 cS at 100° C. and 40° C., respectively. This example demonstrated that the reaction can be carried out in a batch operation.

The 1-decene oligomers as described below were synthesized by reacting purified 1-decene with an activated chromium on silica catalyst. The activated catalyst was prepared by calcining chromium acetate (1 or 3% Cr) on silica gel at 500°-800° C. for 16 hours, followed by treating the catalyst with CO at 300°-350° C. for 1 hour. 1-Decene was mixed with the activated catalyst and heated to reaction temperature for 16-21 hours. The catalyst was then removed and the viscous product was distilled to remove low boiling components at 200° C./0.1 mmHg.

Reaction conditions and results for the lube synthesis of HVI-PAO are summarized below:

TABLE 1

| Example No. | Cr on Silica | Calcination Temp. | Treatment Temp. | 1-decene/ Catalyst Ratio | Lube Yld |
|---|---|---|---|---|---|
| 8 | 3 wt % | 700° C. | 350° C. | 40 | 90 |
| 9 | 3 | 700 | 350 | 40 | 90 |
| 10 | 1 | 500 | 350 | 45 | 86 |
| 11 | 1 | 600 | 350 | 16 | 92 |

Branch Ratios and Lube Properties of Examples 8-11 Alpha Olefin Oligomers

TABLE 2

| Example No. | Branch Ratios $\frac{CH_3}{CH_2}$ | V40° C. | V100° C. | VI |
|---|---|---|---|---|
| 8 | 0.14 | 150.5 | 22.8 | 181 |
| 9 | 0.15 | 301.4 | 40.1 | 186 |
| 10 | 0.16 | 1205.9 | 128.3 | 212 |
| 11 | 0.15 | 5238.0 | 483.1 | 271 |

Branch Ratios and Lubricating Properties of Alpha Olefin Oligomers Prepared in the Prior-Art

TABLE 3

| Example No. | Branch Ratios $\frac{CH_3}{CH_2}$ | V40° C. | V100° C. | VI |
|---|---|---|---|---|
| 12 | 0.24 | 28.9 | 5.21 | 136 |
| 13 | 0.19 | 424.6 | 41.5 | 148 |
| 14 | 0.19 | 1250 | 100 | 168 |
| 15 | 0.19 | 1247.4 | 98.8 | 166 |

These samples are obtained from the commercial market. They have higher branch ratios than samples in Table 2. Also, they have lower VI's than the previous samples.

Comparison of these two sets of lubricants clearly demonstrates that oligomers of alpha-olefins, as 1-decene, with branch ratios lower than 0.19, preferably from 0.13 to 0.18, have higher VI and are better lubricants. The examples prepared in accordance with this invention have branch ratios of 0.14 to 0.16, providing lube oils of excellent quality which have a wide range of viscosities from 3 to 483.1 cs at 100° C. with viscosity indices of 130 to 280.

EXAMPLE 16

A commercial Cr on silica catalyst which contains 1% Cr on a large pore volume synthetic silica gel is used. The catalyst is first calcined with air at 700° C. for 16 hours and reduced with CO at 350° C. for one to two hours. 1.0 part by weight of the activated catalyst is added to 1-decene of 200 parts by weight in a suitable reactor and heated to 185° C. 1-Decene is continuously fed to the reactor at 2-3.5 parts/minute and 0.5 parts by weight of catalyst is added for every 100 parts of 1-decene feed. After 1200 parts of 1-decene and 6 parts of catalyst are charged, the slurry is stirred for 8 hours. The catalyst is filtered and light product boiled below 150° C. at 0.1 mm Hg is stripped. The residual product is hydrogenated with a Ni on Kieselguhr catalyst at 200° C. The finished product has a viscosity at 100° C. of 18.5 cs, VI of 165 and pour point of −55° C.

EXAMPLE 17

Similar as in Example 16, except reaction temperature is 125° C. The finished product has a viscosity at 100° C. of 145 cs, VI of 214, pour point of −40° C.

EXAMPLE 18

Similar as in Example 16, except reaction temperature is 100° C. The finished product has a viscosity at 100° C. of 298 cs, VI of 246 and pour point of −32° C.

The final lube products in Example 16 to 18 contain the following amounts of dimer and trimer and isomeric distribution (distr.).

| Example | 16 | 17 | 18 |
|---|---|---|---|
| Vcs @ 100 ° C. | 18.5 | 145 | 298 |
| VI | 165 | 214 | 246 |
| Pour Point, °C. | −55° C. | −40° C. | −32 |
| wt % dimer | 0.01 | 0.01 | 0.027 |
| | wt % isomeric distr. dimer | | |
| n-eicosane | 51% | 28% | 73% |
| 9-methylnonacosane | 49% | 72% | 27% |
| wt % trimer | 5.53 | 0.79 | 0.27 |
| | wt % isomeric distr. trimer | | |
| 11-octyldocosane | 55 | 48 | 44 |
| 9-methyl, 11-octyl-heneicosane | 35 | 49 | 40 |
| others | 10 | 13 | 16 |

These three examples demonstrate that the new HVI-PAO of wide viscosities contain the dimer and trimer of unique structures in various proportions.

The molecular weights and molecular weight distributions are analyzed by a high pressure liquid chromatography, composed of a Constametric II high pressure, dual piston pump from Milton Roy Co. and a Tracor 945 LC detector. During analysis, the system pressure is 650 psi and THF solvent (HPLC grade) deliver rate is 1 cc per minute. The detector block temperature is set at 145° C. cc of sample, prepared by dissolving 1 gram PAO sample in cc THF solvent, is injected into the chromatograph. The sample is eluted over the following columns in series, all from Waters Associates: Utrastyragel $10^5$ A, P/N 10574, Utrastyragel $10^4$ A, P/N 10573, Utrastyragel $10^3$ A, P/N 10572, Utrastyragel 500 A, P/N 10571. The molecular weights are calibrated against commercially available PAO from Mobil Chemical Co, Mobil SHF-61 and SHF-81 and SHF-401.

The following table summarizes the molecular weights and distributions of Examples 16 to 18.

| Examples | 16 | 17 | 18 |
|---|---|---|---|
| V @ 100° C., cs | 18.5 | 145 | 298 |
| VI | 165 | 214 | 246 |
| number-averaged molecular weights, $MW_n$ | 1670 | 2062 | 5990 |
| weight-averaged molecular weights, MW = w | 2420 | 4411 | 13290 |
| molecular weight | 1.45 | 2.14 | 2.22 |

-continued

| Examples | 16 | 17 | 18 |
|---|---|---|---|
| distribution, MWD | | | |

Under similar conditions, HVI-PAO product with viscosity as low as 3 cs and as high as 500 cs, with VI between 130 and 280, can be produced.

The use of supported Group VIB oxides as a catalyst to oligomerize olefins to produce low branch ratio lube products with low pour points was heretofore unknown. The catalytic production of oligomers with structures having a low branch ratio which does not use a corrosive co-catalyst and produces a lube with a wide range of viscosities and good V.I.'s was also heretofore unknown and more specifically the preparation of lube oils having a branch ratio of less than about 0.19 was also unknown heretofore.

EXAMPLE 19

1-hexene HVI-PAO oligomers of the present invention have been shown to have a very uniform linear $C_4$ branch and contain regular head-to-tail connections. In addition to the structures from the regular head-to-tail connections, the backbone structures have some head-to-head connection, indicative of the follow structure as confirmed by NMR:

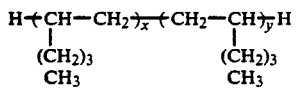

The NMR poly(1-hexene) spectra are shown in FIG. 1.

The oligomerization of 1-decene by reduced valence state, supported chromium also yields a HVI-PAO with a structure analogous to that of 1-hexene oligomer. The lubricant products after distillation to remove light fractions and hydrogenation have characteristic C-13 NMR spectra. FIGS. 2, 3 and 4 are the C-13 NMR spectra of typical HVI-PAO lube products with viscosities of 5 cs, 50 cs and 145 cs at 100° C.

In the following tables, Table A presents the NMR data for FIG. 2, Table B presents the NMR data for FIG. 3 and Table C presents the NMR data for FIG. 4.

TABLE A (FIG. 2)

| Point | Shift(ppm) | Intensity | Width(Hz) |
|---|---|---|---|
| 1 | 79.096 | 138841. | 2.74 |
| 2 | 74.855 | 130653. | 4.52 |
| 3 | 42.394 | 148620. | 6.68 |
| 4 | 40.639 | 133441. | 37.6 |
| 5 | 40.298 | 165678. | 32.4 |
| 6 | 40.054 | 176339. | 31.2 |
| 7 | 39.420 | 134904. | 37.4 |
| 8 | 37.714 | 445452. | 7.38 |
| 9 | 37.373 | 227254. | 157 |
| 10 | 37.081 | 145467. | 186 |
| 11 | 36.788 | 153096. | 184 |
| 12 | 36.593 | 145681. | 186 |
| 13 | 36.447 | 132292. | 189 |
| 14 | 36.057 | 152778. | 184 |
| 15 | 55.619 | 206141. | 184 |
| 16 | 55.082 | 505413. | 26.8 |
| 17 | 34.551 | 741424. | 14.3 |
| 18 | 34.059 | 1265077. | 7.65 |
| 19 | 32.207 | 5351568. | 1.48 |
| 20 | 30.403 | 3563751. | 4.34 |
| 21 | 29.965 | 8294773. | 2.56 |

TABLE A-continued (FIG. 2)

| Point | Shift(ppm) | Intensity | Width(Hz) |
|---|---|---|---|
| 22 | 29.623 | 4714955. | 3.67 |
| 23 | 28.356 | 369728. | 10.4 |
| 24 | 28.161 | 305878. | 13.2 |
| 25 | 26.991 | 1481260. | 4.88 |
| 26 | 22.897 | 4548162. | 1.76 |
| 27 | 20.265 | 227694. | 1.99 |
| 28 | 14.221 | 4592991. | 1.62 |

TABLE B (FIG. 3)

| No. | Freq(Hz) | PPM | Int % |
|---|---|---|---|
| 1 | 1198.98 | 79.147 | 1856 |
| 2 | 1157.95 | 77.004 | 1040 |
| 3 | 1126.46 | 74.910 | 1025 |
| 4 | 559.57 | 37.211 | 491 |
| 5 | 526.61 | 35.019 | 805 |
| 6 | 514.89 | 34.240 | 1298 |
| 7 | 509.76 | 33.899 | 1140 |
| 8 | 491.45 | 32.681 | 897 |
| 9 | 482.66 | 32.097 | 9279 |
| 10 | 456.29 | 30.344 | 4972 |
| 11 | 488.24 | 29.808 | 9711 |
| 12 | 444.58 | 29.564 | 7463 |
| 13 | 426.26 | 28.347 | 1025 |
| 14 | 401.36 | 26.691 | 1690 |
| 15 | 342.77 | 22.794 | 9782 |
| 16 | 212.40 | 14.124 | 8634 |
| 17 | 0.00 | 0.000 | 315 |

TABLE C (FIG. 4)

| Point | Shift(ppm) | Intensity | Width(Hz) |
|---|---|---|---|
| 1 | 76.903 | 627426. | 2.92 |
| 2 | 40.811 | 901505. | 22.8 |
| 3 | 40.568 | 865686. | 23.1 |
| 4 | 40.324 | 823178. | 19.5 |
| 5 | 37.158 | 677621. | 183. |
| 6 | 36.915 | 705894. | 181. |
| 7 | 36.720 | 669037. | 183. |
| 8 | 36.428 | 691870. | 183. |
| 9 | 36.233 | 696323. | 181. |
| 10 | 35.259 | 1315574. | 155. |
| 11 | 35.015 | 1471226. | 152. |
| 12 | 34.333 | 1901096. | 121. |
| 13 | 32.726 | 1990364. | 120. |
| 14 | 32.141 | 2031911-0. | 2.81 |
| 15 | 31.362 | 1661594. | 148. |
| 16 | 30.388 | 9516199. | 19.6 |
| 17 | 29.901 | 1777889-2. | 9.64 |
| 18 | 29.609 | 1870623-6. | 9.17 |
| 19 | 28.391 | 1869681. | 122. |
| 20 | 27.514 | 1117864. | 173. |
| 21 | 26.735 | 2954012. | 14.0 |
| 22 | 22.839 | 2089552-6. | 2.17 |
| 23 | 14.169 | 1667013-0. | 2.06 |

In general, the novel oligomers have the following regular head-to-tail structure where n can be 3 to 17:

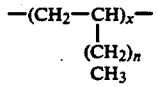

with some head-to-head connections.

The trimer of 1-decene HVI-PAO oligomer is separated from the oligomerization mixture by distillation from a 20 cS as-synthesized HVI-PAO in a short-path apparatus in the range of 165°-210° C. at 0.1-0.2 torr. The unhydrogenated trimer exhibited the following viscometric properties:

V at $_{40}$°C.=14.88 cS;

V at $_{100}$°C.=3.67 cS;

VI=137.

The trimer is hydrogenated at 235° C. and 4200 kPa $H_2$ with Ni on kieselguhr hydrogenation catalyst to give a hydrogenated HVI-PAO trimer with the following properties:

V at $_{40}$°C.=16.66; V at $_{100}$°C. =3.91;

VI=133.

Pour Point=less than −45° C.

Gas chromatographic analysis of the trimer reveals that it is composed of essentially two components having retention times of 1810 seconds and 1878 seconds under the following conditions:

G. C. column-60 meter capillary column, 0.32 mmid, coated with stationary phase SPB-1 with film thickness 0.25 mm, available from Supelco chromatography supplies, catalog no. 2-4046.

Separation Conditions—Varian Gas chromatograph, model no. 3700, equipped with a flame ionization detector and capillary injector port with split ratio of about 50. $N_2$ carrier gas flow rate is 2.5 cc/minute. Injector port temperature 300° C.; detector port temperature 330° C., column temperature is set initially at 45° C. for 6 minutes, programmed heating at 15° C./minute to 300° C. final temperature and holding at final temperature for 60 minutes. Sample injection size is 1 microliter. Under these conditions, the retention time of a g.c. standard, n-dodecane, is 968 seconds.

The C-13 NMR spectra, (FIG. 5), of the distilled C30 product confirm the chemical structures. Table D lists C-13 NMR data for FIG. 5.

TABLE D (FIG. (5))

| Point | Shift(ppm) | Intensity | Width(Hz) |
|---|---|---|---|
| 1 | 55.987 | 11080. | 2.30 |
| 2 | 42.632 | 13367. | 140. |
| 3 | 42.388 | 16612. | 263. |
| 4 | 37.807 | 40273. | 5.90 |
| 5 | 37.319 | 12257. | 16.2 |
| 6 | 36.539 | 11374. | 12.1 |
| 7 | 35.418 | 11631. | 35.3 |
| 8 | 35.126 | 33099. | 3.14 |
| 9 | 34.638 | 39277. | 14.6 |
| 10 | 34.054 | 110899. | 3.32 |
| 11 | 33.615 | 12544. | 34.9 |
| 12 | 33.469 | 13698. | 34.2 |
| 13 | 32.981 | 11278. | 5.69 |
| 14 | 32.835 | 13785. | 57.4 |
| 15 | 32.201 | 256181. | 1.41 |
| 16 | 31.811 | 17867. | 24.6 |
| 17 | 31.470 | 13327. | 57.4 |
| 18 | 30.398 | 261859. | 3.36 |
| 19 | 29.959 | 543993. | 1.89 |
| 20 | 29.618 | 317314. | 1.19 |
| 21 | 28.838 | 11325. | 15.1 |
| 22 | 28.351 | 24926. | 12.4 |
| 23 | 28.156 | 29663. | 6.17 |
| 24 | 27.230 | 44024. | 11.7 |
| 25 | 26.986 | 125437. | −0.261 |
| 26 | 22.892 | 271278. | 1.15 |
| 27 | 20.260 | 17578. | −22.1 |
| 28 | 14.167 | 201979. | 2.01 |

The individual peak assignment of the C-13 spectra are shown in FIG. 5. Based on these structures, the calculated chemical shifts matched closely with the observed chemical shifts. The calculation of chemical shifts of hydrocarbons is carried out as described is "Carbon-13 NMR for Organic Chemists" by G. C. Levy nd G. L. Nelson, 1972, by John Wiley & Sons, Inc., Chapter 3, p 38-41. The components were identified as 9-methyl, 11-octylheneicosane and 11-octyldocosane by infra-red and C-13 NMR analysis and were found to be present in a ratio between 1:10 and 10:1 heneicosane to docosane. The hydrogenated 1-decene trimer produced by the process of this invention has an index of refraction at 60° C. of 1.4396.

The process of the present invention produces a surprisingly simpler and useful dimer compared to the dimer produced by 1-alkene oligomerization with $BF_3$ or $AlCl_3$ as commercially practiced. Typically, in the present invention it has been found that a significant proportion of unhydrogenated dimerized 1-alkene has a vinylidenyl structure as follows:

$$CH_2{=}CR_1R_2$$

where $R_1$ and $R_2$ are alkyl groups representing the residue from the head-to-tail addition of 1-alkene molecules. For example, 1-decene dimer of the invention has been found to contain only three major components, as determined by GC. Based on $C^{13}$ NMR analysis, the unhydrogenated components were found to be 8-eicosene, 9-eicosene, 2-octyldodecene and 9-methyl-8 or 9-methyl-9-nonadecene. The hydrogenated dimer components were found to be n-eicosane and 9-methylnonacosane.

What is claimed is:

1. A liquid sulfur adduct of an unsaturated oligomer composition formed from an alpha olefin having six to twenty carbon atoms, said oligomer having a methyl group to methylene group branch ratio of less than 0.19 and comprising the oligomerization product of said alpha olefin in contact with reduced chromium oxide catalyst on a porous support, said catalyst having been treated by oxidation at a temperature of 200° to 900° C., in the presence of an oxidizing gas and then by treatment with a reducing agent at a temperature and for a time sufficient to reduce said catalyst; wherein the sulfur adduct has a sulfur content of 0.01 to 5 moles based on mole(s) of oligomer and is selected from the group consisting of sulfide, disulfide, polysulfides, and admixtures thereof.

2. The sulfur adduct of claim 1, wherein the derivative has a sulfur content ranging from 0.1 to 1 mole based on the moles of oligomer.

3. The sulfur adduct of claim 1, wherein the alpha olefin is 1-decene.

4. The sulfur adduct of claim 1, wherein the alpha olefin is 1-decene and wherein the oligomer exhibits the C-13 NMR of FIG. 2.

5. The sulfur adduct of claim 1 wherein said oligomer has 30 to 1500 carbon atoms.

6. The sulfur adduct of claim 1 wherein the oligomer has 30 to 1000 carbon atoms.

7. The sulfur adduct of claim 1 wherein the oligomer is characterized by viscosity at 100° C. ranging from 3 cS to 5000 cS.

8. As a lubricant, a liquid mixture comprising the sulfur adduct of claim 1.

9. The lubricant of claim 8, wherein the mixture has a sulfur content of 0.1 to 1 moles based on one mole of oligomer.

10. The lubricant of claim 8, wherein the alpha olefin is 1-decene.

11. The lubricant of claim 8, wherein the alpha olefin is 1-decene and the oligomer contains a component which exhibits the C-13 nmr of FIG. 2.

12. The lubricant of claim 8, wherein said oligomer contains 30 to 1500 carbon atoms.

13. The lubricant of claim 8 wherein said oligomer has 30 to 1000 carbon atoms.

14. The lubricant of claim 8, which is free of zinc and free of phosphorus.

15. A lubricant comprising a lubricating oil and as an antiwear additive the sulfide adduct of claim 1.

16. The lubricant of claim 15, wherein the lubricating oil is a mineral oil.

17. The lubricant of claim 15, wherein the lubricating oil is a synthetic lubricating oil.

18. The lubricant of claim 15, wherein the lubricating oil is an oligomer of 1-decene.

19. The lubricant of claim 18, wherein the oligomer exhibits the C-13 NMR of FIG. 2.

20. The lubricant of claim 18, wherein the oligomer includes a moiety

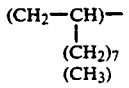

21. The lubricant of claim 15, which is free of zinc and free of phosphorus.

22. The lubricant of claim 15, wherein the lubricating oil is selected from the group consisting of a mineral oil, a synthetic lubricant, a grease, a thickened lubricant and admixtures thereof.

23. The lubricant of claim 8, wherein the adduct comprises 50 to 100% by weight of the lubricant.

24. The lubricant of claim 23, which includes an additive selected from the group consisting of dispersants, detergents, extreme pressure/antiwear, antioxidants, emulsifiers, demulsifiers, corrosion inhibitors, antirust inhibitors, antistain reagents, friction reducers and admixtures thereof.

* * * * *